US010429754B2

(12) United States Patent
Takahashi et al.

(10) Patent No.: US 10,429,754 B2
(45) Date of Patent: Oct. 1, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Koji Takahashi, Kashiwa (JP); Mai Murakami, Kashiwa (JP); Yoshihisa Saito, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/996,741

(22) Filed: Jun. 4, 2018

(65) Prior Publication Data

US 2018/0356745 A1 Dec. 13, 2018

(30) Foreign Application Priority Data

Jun. 9, 2017 (JP) ..... 2017-114505

(51) Int. Cl.

| | |
|---|---|
| ***G03G 5/00*** | (2006.01) |
| ***G03G 5/147*** | (2006.01) |
| ***G03G 21/18*** | (2006.01) |
| ***G03G 5/06*** | (2006.01) |
| ***G03G 5/07*** | (2006.01) |

(52) U.S. Cl.

CPC ..... *G03G 5/14756* (2013.01); *G03G 5/0614* (2013.01); *G03G 5/0618* (2013.01); *G03G 5/0672* (2013.01); *G03G 5/071* (2013.01); *G03G 5/075* (2013.01); *G03G 5/14734* (2013.01); *G03G 5/14786* (2013.01); *G03G 5/14795* (2013.01); *G03G 21/1803* (2013.01)

(58) Field of Classification Search

CPC ..... G03G 5/14756; G03G 5/14734
USPC ..... 430/66
See application file for complete search history.

(56) References Cited

U.S. PATENT DOCUMENTS

| | | | |
|---|---|---|---|
| 6,405,005 | B1 | 6/2002 | Kitamura et al. |
| 7,813,675 | B2 | 10/2010 | Tanabe et al. |

(Continued)

FOREIGN PATENT DOCUMENTS

| | | | |
|---|---|---|---|
| JP | 2007-047655 | A | 2/2007 |
| JP | 2007-072277 | A | 3/2007 |

(Continued)

*Primary Examiner* — Mark A Chapman
(74) *Attorney, Agent, or Firm* — Venable LLP

(57) ABSTRACT

Provided is an electrophotographic photosensitive member, including: a support; a charge-generating layer on the support; a charge-transporting layer on the charge-generating layer; and a protective layer on the charge-transporting layer, wherein the protective layer contains the following components (α), (β), and (γ): (α) a polymer of a hole-transportable compound; (β) a polycarbonate resin; and (γ) a hole-transportable compound, wherein a content of the component (β) in the protective layer is 0.01 mass % or more and 4.0 mass % or less with respect to a content of the component (α) in the protective layer, wherein a content of the component (γ) in the protective layer is 0.001 mass % or more and 3.0 mass % or less with respect to the content of the component (α) in the protective layer, and wherein the charge-transporting layer contains the component (γ).

12 Claims, 1 Drawing Sheet

(56) References Cited

U.S. PATENT DOCUMENTS

| | | | | |
|---|---|---|---|---|
| 8,021,811 | B2 * | 9/2011 | De Jong | G03G 5/043 430/132 |
| 8,457,528 | B2 | 6/2013 | Ochi et al. | |
| 8,647,798 | B2 | 2/2014 | Asano et al. | |
| 8,865,380 | B2 | 10/2014 | Noguchi et al. | |
| 9,034,543 | B2 | 5/2015 | Iwadate et al. | |
| 9,114,565 | B2 | 8/2015 | Kawai et al. | |
| 9,389,521 | B2 | 7/2016 | Takahashi et al. | |
| 9,766,561 | B2 | 9/2017 | Takahashi et al. | |
| 9,772,596 | B2 | 9/2017 | Mitsui et al. | |
| 9,791,792 | B2 | 10/2017 | Miyauchi et al. | |
| 9,811,012 | B2 | 11/2017 | Murakami et al. | |
| 9,983,490 | B2 | 5/2018 | Shimada et al. | |
| 2014/0004450 | A1 | 1/2014 | Tokimitsu et al. | |
| 2014/0093281 | A1 | 4/2014 | Takahashi et al. | |
| 2017/0108790 | A1 | 4/2017 | Takahashi et al. | |

FOREIGN PATENT DOCUMENTS

| | | | |
|---|---|---|---|
| JP | 2013-54132 | A | 3/2013 |
| JP | 2014-191118 | A | 10/2014 |

* cited by examiner

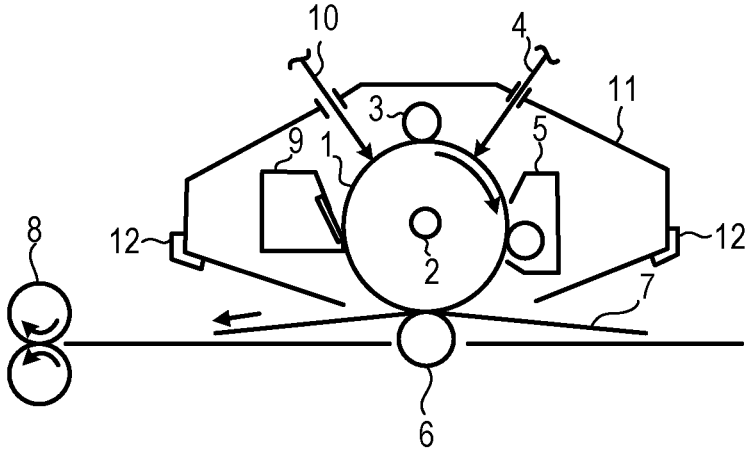
10
4
11
3
9
1
5
8
12
12
2
7
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

In recent years, the diversification of the users of an electrophotographic apparatus has been advancing, and hence an image to be output has been required to have image quality higher than conventional image quality and to show no change in image quality during the time period for which the apparatus is used.

In Japanese Patent Application Laid-Open No. 2013-54132, as a technology for suppressing an electric potential fluctuation, there is a disclosure of a technology concerning an electrophotographic photosensitive member having a protective layer obtained by polymerizing a composition containing a specific polymerizable compound and a specific compound.

In addition, in Japanese Patent Application Laid-Open No. 2014-191118, there is a disclosure of a technology concerning an electrophotographic photosensitive member improved in electrical characteristics and flaw resistance by specifying the content of a specific compound in its surface layer based on the peak area of a spectrum obtained by attenuated total reflection infrared spectroscopy.

As described above, in association with the diversification of the users of the electrophotographic apparatus, not only image quality but also matters such as satisfactory operability of the apparatus and an improvement in ease of maintenance thereof are important elements. Accordingly, at present, a simple consumable article has started to be exchanged by a user himself or herself. Also in that case, it is of course required that the same image quality as that in the case of the exchange of the consumable article by a serviceman be obtained.

An investigation by the present inventors has revealed that an electrophotographic photosensitive member using a construction of Japanese Patent Application Laid-Open No. 2013-54132 or Japanese Patent Application Laid-Open No. 2014-191118 causes a problem called image unevenness when exposed to excessive white light for a long time period. In addition, the investigation has revealed that an electrophotographic photosensitive member using the construction of Japanese Patent Application Laid-Open No. 2014-191118 may cause a problem called an increase in residual potential.

The foregoing means that when a consumable article is exchanged by a user himself or herself, an electrophotographic photosensitive member is exposed to excessive white light for a long time period, and hence image unevenness or an increase in residual potential may occur.

SUMMARY OF THE INVENTION

Therefore, an object of the present disclosure is to provide an electrophotographic photosensitive member that can provide an image having higher quality and can suppress an increase in residual potential even when exposed to white light for a long time period.

The object is achieved by the present disclosure described below. That is, according to one embodiment of the present disclosure, there is provided an electrophotographic photosensitive member, including: a support; a charge-generating layer on the support; a charge-transporting layer on the charge-generating layer; and a protective layer on the charge-transporting layer, wherein the protective layer contains the following components (α), (β), and (γ): (α) a polymer of a hole-transportable compound represented by the following formula (A); (β) a polycarbonate resin having a structural unit represented by the following formula (B); and (γ) a hole-transportable compound represented by the following formula (C), wherein a content of the component (β) in the protective layer is 0.01 mass % or more and 4.0 mass % or less with respect to a content of the component (α) in the protective layer, wherein a content of the component (γ) in the protective layer is 0.001 mass % or more and 3.0 mass % or less with respect to the content of the component (α) in the protective layer, and wherein the charge-transporting layer contains the component (γ):

(A)

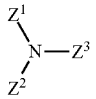

in the formula (A), Z1 to Z3 each independently represent a substituted or unsubstituted aryl group, and a substituent of the aryl group includes a linear or branched alkyl group having 1 or more and 6 or less carbon atoms, a halogen atom, or a polymerizable functional group, provided that the hole-transportable compound represented by the formula (A) has one or more polymerizable functional groups each serving as the substituent;

(B)

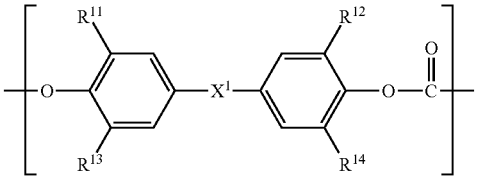

in the formula (B), R11 to R14 each independently represent a hydrogen atom, a methyl group, or an ethyl group, and X1 represents a single bond, an oxygen atom, or a divalent hydrocarbon group;

(C)

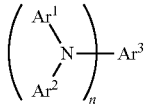

in the formula (C), Ar1 and Ar2 each independently represent a substituted or unsubstituted phenyl group, Ar3 represents an n-valent aromatic group, and n represents an integer of 1 or more and 3 or less.

There can be provided an electrophotographic photosensitive member that is further reduced in memory due to light exposure (hereinafter sometimes described as "photomemory") and can suppress an increase in residual potential, and a process cartridge and an electrophotographic apparatus each including the electrophotographic photosensitive member.

Further features of the present invention will become apparent from the following description of exemplary embodiments with reference to the attached drawing.

BRIEF DESCRIPTION OF THE DRAWINGS

FIGURE is a view for illustrating an example of the schematic construction of an electrophotographic apparatus including a process cartridge including an electrophotographic photosensitive member of the present disclosure.

DESCRIPTION OF THE EMBODIMENTS

Preferred embodiments of the present invention will now be described in detail in accordance with the accompanying drawing.

Now, the present disclosure is described in detail by way of preferred embodiments.

The present disclosure relates to an electrophotographic photosensitive member including: a support; a charge-generating layer on the support; a charge-transporting layer on the charge-generating layer; and a protective layer on the charge-transporting layer, wherein the protective layer contains, as its constituent components, the following components (α), (β), and (γ): (α) a polymer of a hole-transportable compound represented by the formula (A); (β) a polycarbonate resin having a structural unit represented by the formula (B); and (γ) a hole-transportable compound represented by the formula (C), wherein contents of the components (β) and (γ) in the protective layer are specific amounts with respect to a content of the component (α) in the protective layer, and wherein the charge-transporting layer contains the component (γ).

An investigation by the present inventors has found the following. In the construction of Japanese Patent Application Laid-Open No. 2013-54132 or Japanese Patent Application Laid-Open No. 2014-191118, the amount of a hole-transportable compound present in a protective layer is large. Accordingly, a photomemory is caused by: a charge transportation portion corresponding to a photomemory portion caused by excessive charge transportation that temporarily occurs in the protective layer at the time of its light exposure; and an injection portion corresponding to an excessive photomemory portion caused by a temporal increase in quantity of charge to be injected from a charge-transporting layer into the protective layer at an interface between the protective layer and the charge-transporting layer.

In addition, the investigation has found that in the construction of Japanese Patent Application Laid-Open No. 2014-191118, an increase in residual potential is observed in some cases.

The present inventors have investigated the amount of the component (γ) in the protective layer for solving the problems. As a result, the present inventors have found that the occurrence of the photomemory and the increase in residual potential that have occurred in the related art can be suppressed by: incorporating the component (γ) at a content of 0.001 mass % or more and 3.0 mass % or less with respect to the component (α); incorporating the component (β) at a content of 0.01 mass % or more and 4.0 mass % or less with respect to the component (α); and incorporating the component (γ) into the charge-transporting layer.

The present inventors have considered the mechanism via which the occurrence of the photomemory can be suppressed by the construction of the present disclosure to be as described below. When a hole-transportable compound is exposed to light for a long time period, a path configured to perform excessive hole transportation is temporarily formed to increase the amount of the photomemory in some cases. The present inventors have considered that the path configured to perform excessive hole transportation is more likely to occur in a hole-transportable compound that is not bound than in a hole-transportable compound that is present as a polymer and bound from its surroundings. In view of the foregoing, the present inventors have assumed that the formation of the path can be suppressed by controlling the amount of the component (γ) with respect to the component (α) present in the protective layer. The present inventors have assumed that when a specific amount of the component (β) is incorporated into the protective layer in addition to the foregoing, the formation of the path configured to perform excessive hole transportation, the formation occurring in each of the components (α) and (γ) in the protective layer, is suppressed, and hence the occurrence of the photomemory is further reduced. The present inventors have considered that when the component (γ) is incorporated into the charge-transporting layer in addition to the foregoing, a balance between the injection and residence of the charge at the interface between the charge-transporting layer and the protective layer, the injection and the residence occurring in the case where the electrophotographic photosensitive member is exposed to light, is optimized, and hence a further suppressing effect on the occurrence of the photomemory is exhibited. In addition, the present inventors have considered that when the content of the component (β) in the protective layer is set to a proper value, the remaining and residence of the charge in the protective layer are also simultaneously optimized, and hence the increase in residual potential of the electrophotographic photosensitive member is also suppressed.

When the respective constructions synergistically act on each other like the foregoing mechanism, the effects of the present disclosure can be achieved.

<With Regard to Component (α)>

The component (α) is a polymer of a hole-transportable compound represented by the following formula (A):

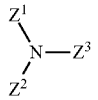

(A)

in the formula (A), Z1 to Z3 each independently represent a substituted or unsubstituted aryl group, and a substituent of the aryl group includes a linear or branched alkyl group having 1 or more and 6 or less carbon atoms, a halogen atom, or a polymerizable functional group, provided that the hole-transportable compound represented by the formula (A) has one or more polymerizable functional groups each serving as the substituent.

An acryloyloxy group or a methacryloyloxy group, or a hydroxy group or a hydroxymethyl group is preferred as the polymerizable functional group from the viewpoints ofabrasion resistance and the strength by which a hole-transportable moiety in the polymer is bound. Further, the protective layer more preferably contains a compound having two or more acryloyloxy groups or methacryloyloxy groups because of the above-mentioned reasons. In order to obtain the effects of the present disclosure, more specific examples of the hole-transportable compound represented by the formula (A) include hole-transportable compounds represented by the following formulae (A-1) to (A-14). Those compounds may be used alone or as a mixture thereof.

(A-1)

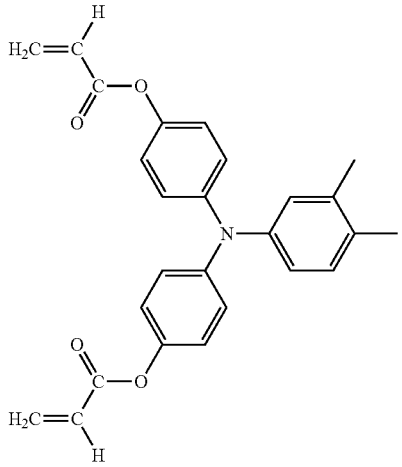

(A-2)

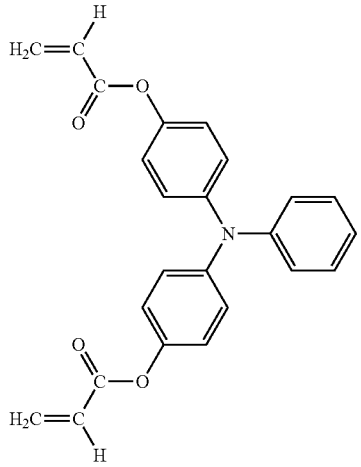

(A-3)

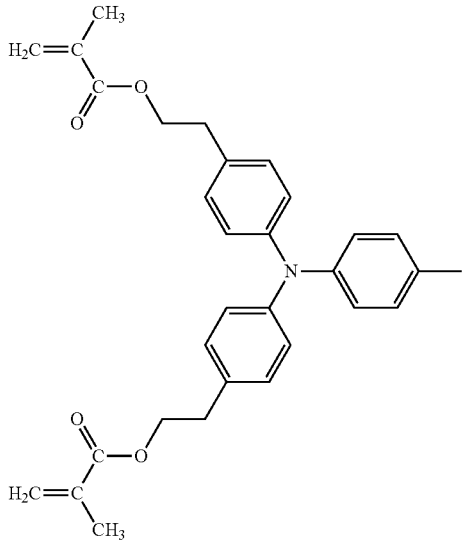

(A-4)

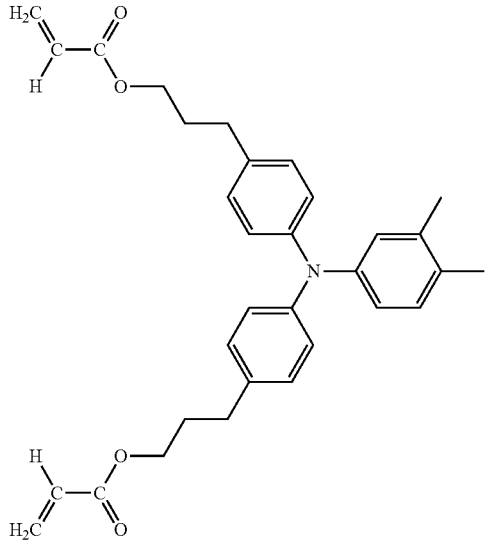

-continued
(A-5)
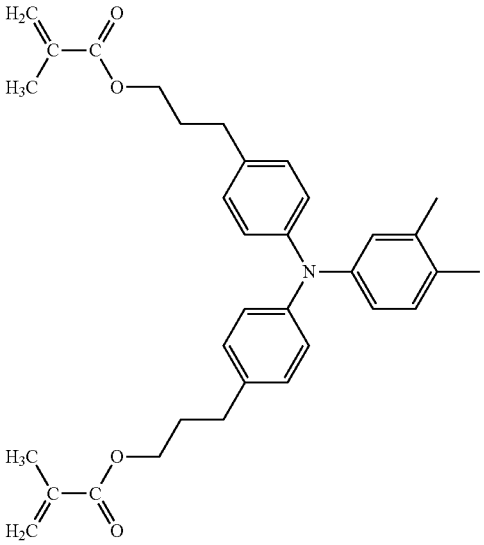
(A-6)
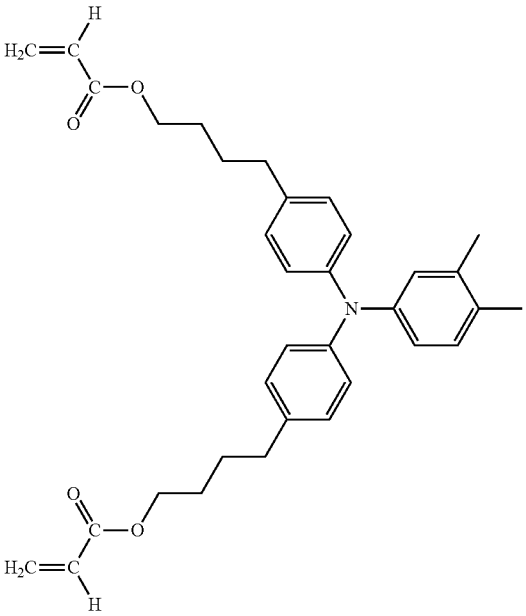
(A-7)
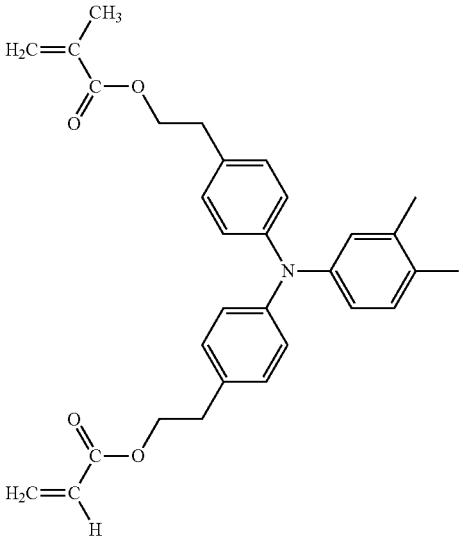
(A-8)
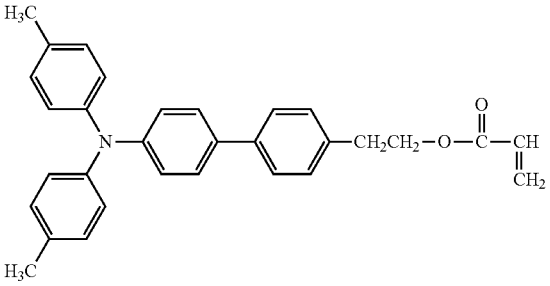
(A-9)
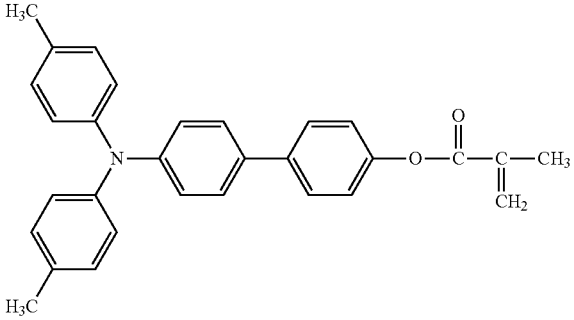

-continued
(A-10)
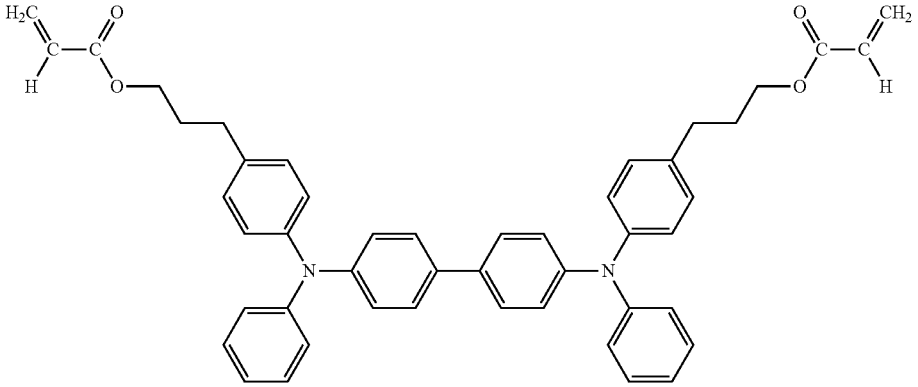
(A-11)
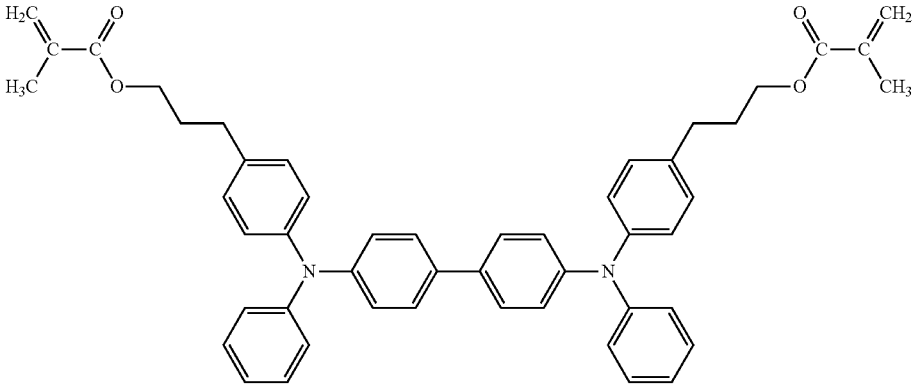
(A-12)
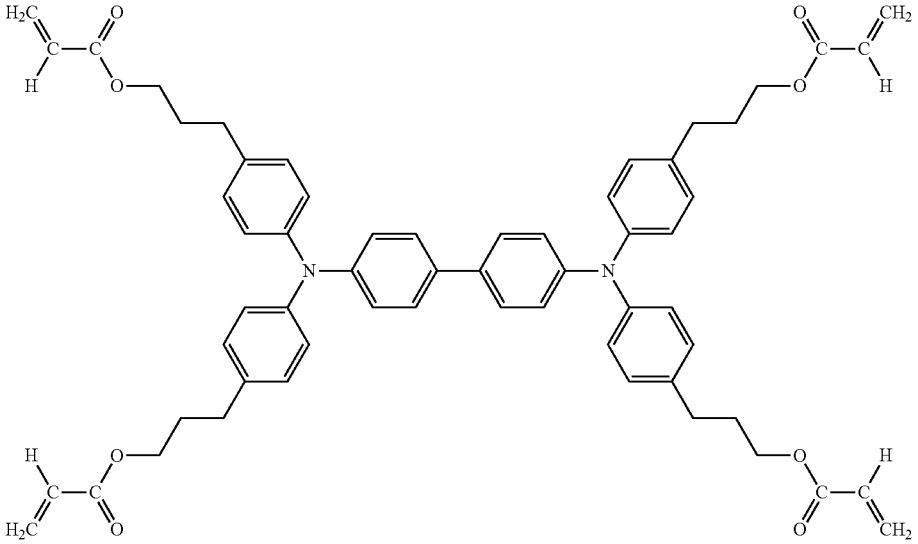
(A-13)
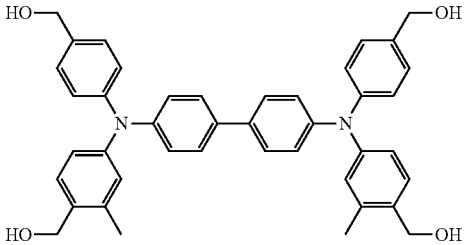
(A-14)
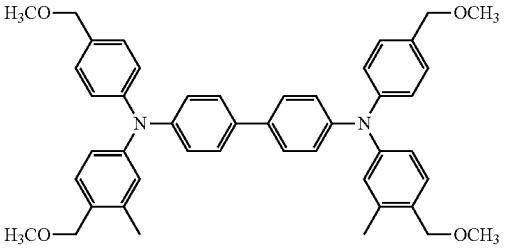

-continued (A-15)

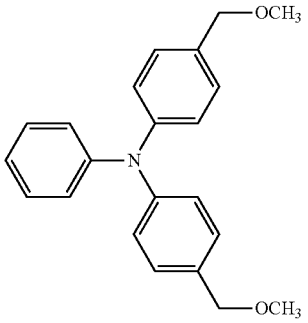

<With Regard to Component (β)>

The component (β) is a polycarbonate resin having a structural unit represented by the following formula (B):

(B)

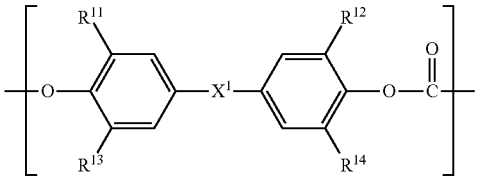

in the formula (B), R11 to R14 each independently represent a hydrogen atom, a methyl group, or an ethyl group, and X1 represents a single bond, an oxygen atom, or a divalent hydrocarbon group.

From the viewpoints of the suppression of excessive formation of a path configured to perform charge transportation and the suppression of excessive charge inflow from the charge-transporting layer, the component ((FS) is preferably a polycarbonate resin having a structural unit represented by any one of the following formulae (B-1) to (B-8). One kind of those structural units may be used to form the component (β) as a homopolymer, or two or more kinds thereof may be used to form the component (β) as a copolymer. The copolymerization form of the structural units may be any one of, for example, the following forms: block copolymerization, random copolymerization, and alternating copolymerization.

(B-1)

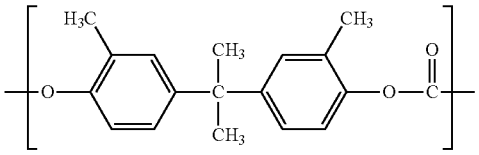

(B-2)

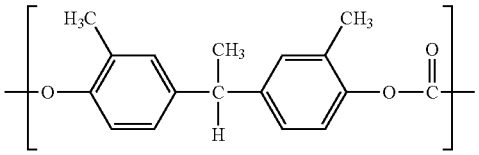

-continued (B-3)

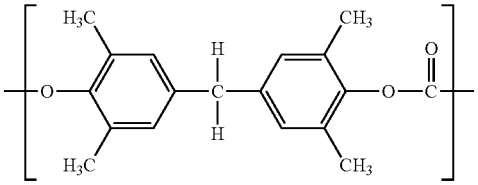

(B-4)

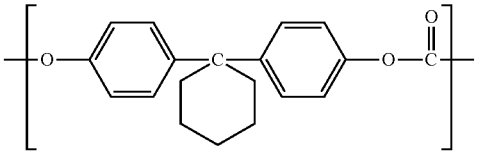

(B-5)

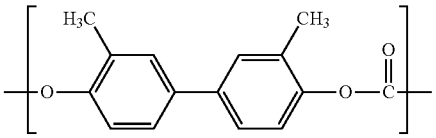

(B-6)

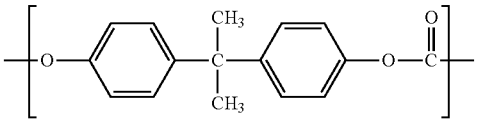

(B-7)

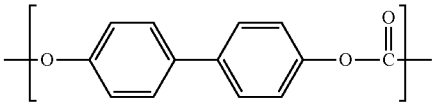

(B-8)

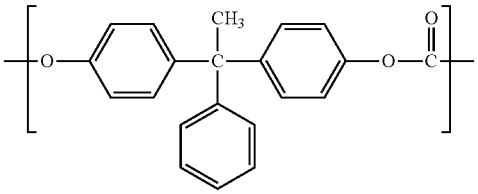

Further, the component (β) is preferably a polycarbonate resin having a weight-average molecular weight (Mw) of 10,000 or more and 120,000 or less. The component (β) is more preferably any one of a resin B1 to a resin B6 shown in Table 1 below. The resin B1 to the resin B6 may be used alone or as a mixture thereof. Those polycarbonate resins may each be synthesized by a known method. For example, the resins may each be synthesized by a method described in Japanese Patent Application Laid-Open No. 2007-047655 or Japanese Patent Application Laid-Open No. 2007-072277.

TABLE 1

| Resin | Repeating structural unit | Ratio between repeating structural units | Weight-average molecular weight (Mw) |
|---|---|---|---|
| Resin B1 | B-4 | — | 55,000 |
| Resin B2 | B-4 | — | 14,000 |
| Resin B3 | B-4 | — | 110,000 |
| Resin B4 | B-6 | — | 55,000 |
| Resin B5 | B-1 | — | 54,000 |
| Resin B6 | B-6/B-1 | 6.5/3.5 | 55,000 |

It is preferred that the content of the component (β) in the protective layer be 0.01 mass % or more with respect to the content of the component (α) in terms of the suppression of the occurrence of the photomemory, and be 4.0 mass % or less with respect thereto in terms of the suppression of the increase in residual potential.

<With Regard to Component (γ)>

The component (γ) is a hole-transportable compound represented by the following formula (C):

(C)

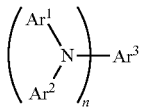

in the formula (C), Ar1 and Ar2 each independently represent a substituted or unsubstituted phenyl group, Ar3 represents an n-valent aromatic group, and n represents an integer of 1 or more and 3 or less.

In the formula (C), specific examples of the substituent of the phenyl group represented by each of Ar1 and Ar2 include a substituted or unsubstituted alkyl group having 1 or more and 4 or less carbon atoms, a substituted or unsubstituted alkoxy group having 1 or more and 4 or less carbon atoms, and a substituted unsaturated hydrocarbon group having 2 or more and 4 or less carbon atoms. Examples of the substituent of the alkyl group having 1 or more and 4 or less carbon atoms, the alkoxy group having 1 or more and 4 or less carbon atoms, and the unsaturated hydrocarbon group having 2 or more and 4 or less carbon atoms include aromatic groups, such as a phenyl group. Preferred examples of the substituent of the phenyl group represented by each of Ar1 and Ar2 include a methyl group, a methoxy group, a 4-phenyl-1,3-butadienyl group, and a 4,4-diphenyl-1,3-butadienyl group.

In the formula (C), specific examples of the aromatic group represented by Ar3 include a phenyl group, a biphenyl group, a 9,9-dimethylfluorenyl group, a stilbenyl group, and a [(styry)styryl]phenyl group. The same substituent as the substituent of the phenyl group represented by each of Ar1 and Ar2 may be used as the substituent of the aromatic group represented by Ar3, and preferred examples thereof include a methyl group, a methoxy group, an ethoxy group, a 2,2-diphenylvinyl group, and a dibenzocy cl oheptene-5-methy dene group.

In order to obtain the effects of the present disclosure, more specific examples of the hole-transportable compound represented by the formula (C) in each of the protective layer and the charge-transporting layer include compounds having such structures as shown below. Those compounds may be used alone or as a mixture thereof.

It is preferred that the content of the component (γ) in the protective layer be 0.001 mass % or more and 3.0 mass % or less with respect to the content of the component (α).

(C-1)

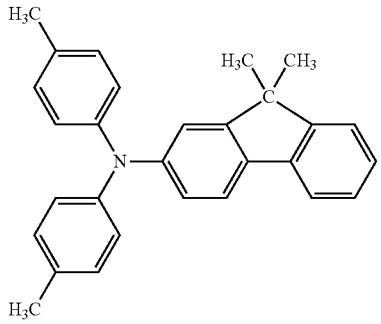

(C-2)

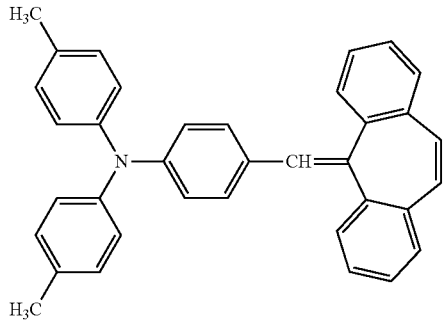

(C-3)

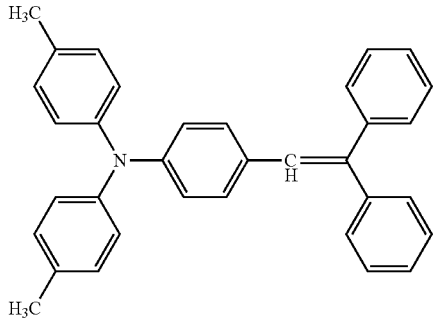

(C-4)

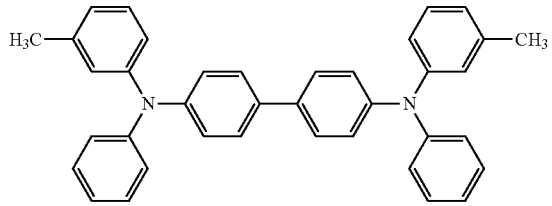

-continued
(C-5)
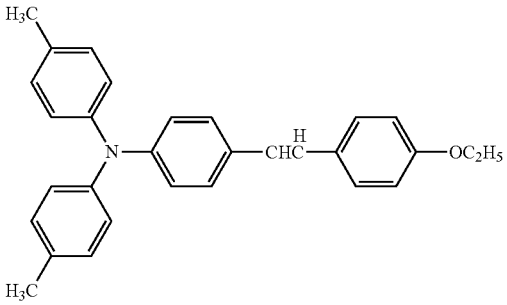
(C-6)
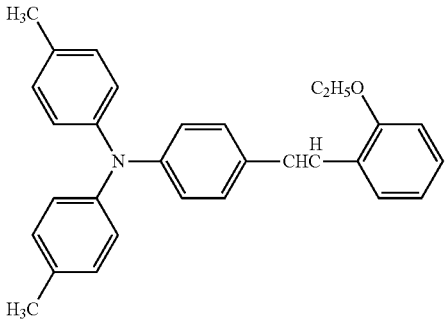
(C-7)
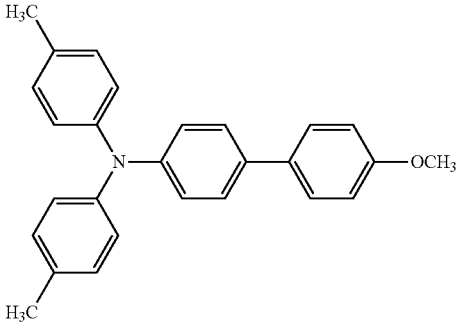
(C-8)
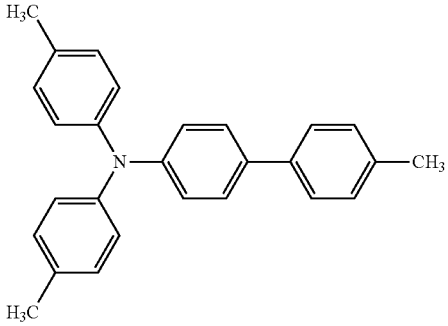
(C-9)
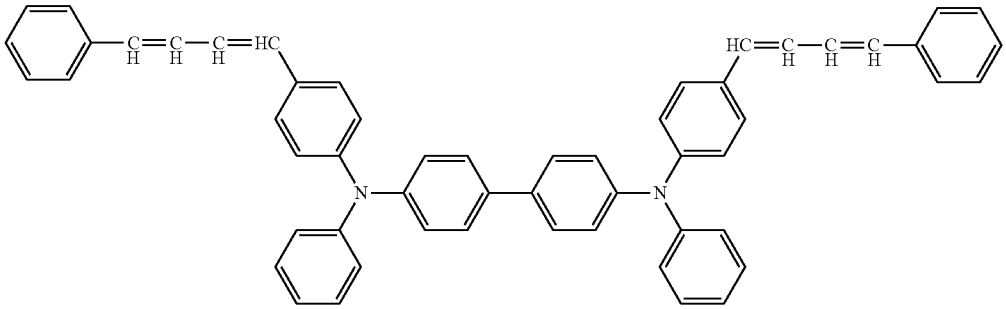
(C-10)
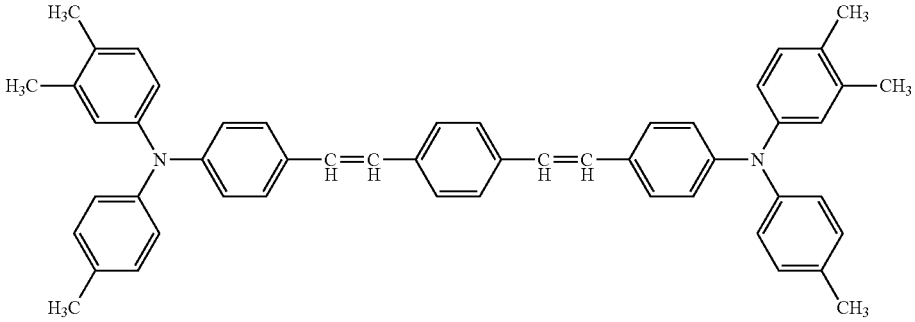

-continued (C-11)

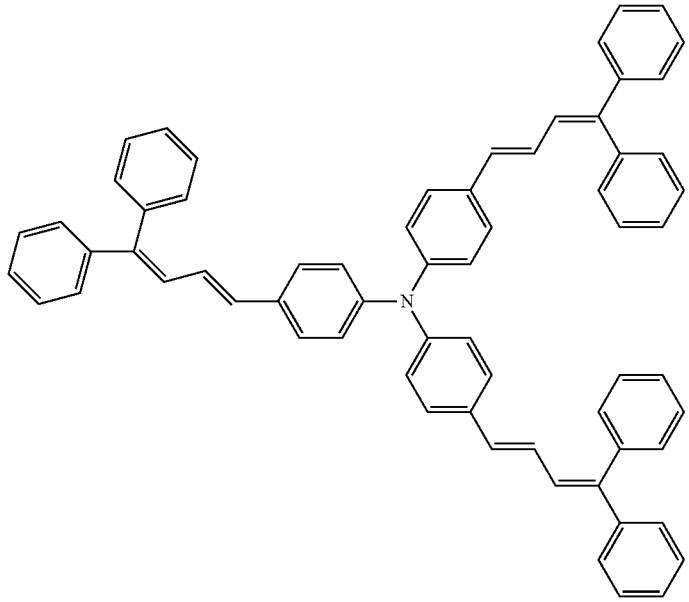

<With Regard to Contents of Components (β) and (γ)>

When the contents of the components (β) and (γ) in the protective layer satisfy the following conditions, a suppressing effect on the occurrence of the photomemory is more efficiently obtained, and hence the effects of the present disclosure are further improved. It is preferred that the content of the component (β) in the protective layer be 0.01 mass % or more and 2.0 mass % or less with respect to the content of the component (α) in the protective layer, and the content of the component (γ) in the protective layer be 0.001 mass % or more and 1.0 mass % or less with respect to the content of the component (α) in the protective layer. In addition, it is more preferred that the content of the component (β) in the protective layer be 0.01 mass % or more and 0.8 mass % or less with respect to the content of the component (α) in the protective layer, and the content of the component (γ) in the protective layer be 0.01 mass % or more and 1.0 mass % or less with respect to the content of the component (α) in the protective layer.

Further, when a content Mβ of the component (β) in the protective layer and a content Mγ of the component (γ) in the protective layer satisfy the following formula, the effects of the present disclosure can be efficiently obtained.

$$0.8 \leq M\beta/M\gamma \leq 500$$

The content of the component (α) in the protective layer, which is not particularly limited, is preferably 50 mass % or more with respect to the total mass of the protective layer.

A method of incorporating the components (β) and (γ) into the protective layer is, for example, a method involving adding the components (β) and (γ) to a coating liquid for a protective layer, or a method involving mixing the components (β) and (γ) in the charge-transporting layer into the protective layer in accordance with a production method for the electrophotographic photosensitive member, such as application conditions and drying conditions for a coating liquid for a charge-transporting layer and/or the coating liquid for a protective layer.

As described above, the effects of the present disclosure can be obtained by incorporating specific amounts of the components (β) and (γ) with respect to the component (α) into the protective layer. The contents of the components (β) and (γ) in the protective layer may be determined by, for example, the following methods.

First, a section of the protective layer is cut out of the surface of the electrophotographic photosensitive member with an ultramicrotome. With regard to the component (β), the content of the component (β) in the protective layer is calculated from a calibration curve by using the area of a peak derived from the component (β) obtained by an infrared spectroscopic reflection spectrum.

With regard to the component (γ), the content of the component (γ) in the protective layer is calculated from a calibration curve by using pyrolysis GC-MS.

<With Regard to Methyl Benzoate and Ethyl Benzoate (δ) (Component (δ))>

In order to obtain high effects of the present disclosure, the charge-transporting layer more preferably contains the following component (δ): (δ) at least one kind selected from the group consisting of methyl benzoate and ethyl benzoate. In this case, the content of the component (δ) is preferably 0.8 mass % or more and 5.0 mass % or less with respect to the total mass of the charge-transporting layer.

The charge-transporting layer is considered to preferably contain the component (δ) because of the following reason.

The present inventors have considered that when the photosensitive member including the protective layer is exposed to light over a long time period, a path causing the injection of excessive charge at the interface between the charge-transporting layer and the protective layer is formed as described in the foregoing. The present inventors have assumed that when the charge-transporting layer contains a specific amount of the component (δ), part of the excessive charge passing the path is trapped, and hence the quantity of the charge injected from the charge-transporting layer into the protective layer is made proper, and as a result, the occurrence of the photomemory is suppressed.

The content of the component (δ) in the charge-transporting layer with respect to the total mass of the charge-transporting layer may be determined by the following measurement method.

The protective layer was removed by polishing the surface of the produced electrophotographic photosensitive member with a polishing sheet. After that, a sample piece measuring 5 mm by 40 mm (hereinafter referred to as "photosensitive member sample piece") was cut out of the remaining part, and was loaded into a vial bottle. A head space sampler (product name: TurboMatrix HS40, manufactured by PerkinElmer, Inc.) was set as follows: Oven 200° C., Loop 205° C., Transfer Line 205° C. The content of the component (δ) in the charge-transporting layer was determined from a calibration curve by measuring the amount of a produced gas with a gas chromatograph (product name: TRACE ISQ, manufactured by Thermo Fisher Scientific Inc.) serving as a quadrupole GC/MS system. A method of removing the protective layer may be freely selected as long as the charge-transporting layer is not affected.

The mass of the charge-transporting layer is determined from a difference between the mass of the photosensitive member sample piece removed from the vial bottle after the measurement and the mass of the sample piece from which the charge-transporting layer has been peeled, and the content of the component (δ). The content of the component (δ) with respect to the total mass of the charge-transporting layer was calculated from the mass of the charge-transporting layer and the content of the component (δ).

The sample piece from which the charge-transporting layer had been peeled was prepared by: immersing the photosensitive member sample piece removed from the vial bottle in methyl ethyl ketone for 5 minutes to peel the charge-transporting layer; and then drying the remaining part at 50° C. for 5 minutes.

[Electrophotographic Photosensitive Member]

The electrophotographic photosensitive member of the present disclosure has a feature of including the support, the charge-generating layer, the charge-transporting layer, and the protective layer in the stated order.

A method of producing the electrophotographic photosensitive member of the present disclosure is, for example, a method involving: preparing coating liquids for the respective layers to be described later; applying the liquids in a desired layer order; and drying the liquids. At this time, a method of applying each of the coating liquids is, for example, dip coating, spray coating, inkjet coating, roll coating, die coating, blade coating, curtain coating, wire bar coating, or ring coating. Of those, dip coating is preferred from the viewpoints of efficiency and productivity.

The respective constructions of the electrophotographic photosensitive member are described below.

<Support>

The support of the electrophotographic photosensitive member of the present disclosure is preferably an electroconductive support. In addition, examples of the shape of the support include a cylindrical shape, a belt shape, and a sheet shape. Of those, a cylindrical support is preferred. In addition, the surface of the support may be subjected to, for example, an electrochemical treatment, such as anodization, a blast treatment, or a cutting treatment.

A metal, a resin, a glass, or the like is preferred as a material for the support.

Examples of the metal include aluminum, iron, nickel, copper, gold, and stainless steel, and alloys thereof. Of those, an aluminum support using aluminum is preferred.

In addition, electroconductivity is preferably imparted to the resin or the glass through a treatment involving, for example, mixing or coating the resin or the glass with an electroconductive material.

<Electroconductive Layer>

In the electrophotographic photosensitive member of the present disclosure, an electroconductive layer may be arranged on the support. The arrangement of the electroconductive layer can conceal flaws and irregularities in the surface of the support, and control the reflection of light on the surface of the support.

The electroconductive layer preferably contains electroconductive particles and a resin.

A material for the electroconductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the electroconductive particles, and in particular, titanium oxide, tin oxide, and zinc oxide are more preferably used.

When the metal oxide is used as the electroconductive particles, the surface of the metal oxide may be treated with a silane coupling agent or the like, or the metal oxide may be doped with an element, such as phosphorus or aluminum, or an oxide thereof.

In addition, each of the electroconductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the electroconductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain a concealing agent, such as a silicone oil, resin particles, or titanium oxide.

The average thickness of the electroconductive layer is preferably 1 μm or more and 50 μm or less, particularly preferably 3 μm or more and 40 μm or less.

The electroconductive layer may be formed by: preparing a coating liquid for an electroconductive layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the electroconductive particles in the coating liquid for an electroconductive layer, there are given methods using a paint shaker, a sand mill, a ball mill, and a liquid collision-type high-speed disperser.

<Undercoat Layer>

In the electrophotographic photosensitive member of the present disclosure, an undercoat layer may be arranged on the support or the electroconductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, an electroconductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form an undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer may be formed by: preparing a coating liquid for an undercoat layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

In the electrophotographic photosensitive member of the present disclosure, a photosensitive layer is a laminated photosensitive layer having a charge-generating layer containing a charge-generating substance and a charge-transporting layer containing a charge-transporting substance. The laminated photosensitive layer has the charge-generating layer and the charge-transporting layer.

(1) Charge-generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably 0.1 μm or more and 1 μm or less, more preferably 0.15 μm or more and 0.4 μm or less.

The charge-generating layer may be formed by: preparing a coating liquid for a charge-generating layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(2) Charge-transporting Layer

The charge-transporting layer needs to contain the charge-transporting substance, and preferably further contains a resin.

The charge-transporting layer contains, as the charge-transporting substance, at least the following component (γ):

(γ) the hole-transportable compound represented by the formula (C):

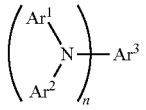

(C)

in the formula (C), Ar1 and Ar2 each independently represent a substituted or unsubstituted phenyl group, Ar3 represents an n-valent aromatic group, and n represents an integer of 1 or more and 3 or less.

The component (γ) is preferably a hole-transportable compound having a structure represented by any one of the formulae (C-1) to (C-11).

In addition, the charge-transporting layer may contain, in addition to the hole-transportable compound represented by the formula (C), for example, a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a levelling agent, a sliding property-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge-transporting layer is preferably 5 μm or more and 50 μm or less, more preferably 8 μm or more and 40 μm or less, particularly preferably 10 μm or more and 30 μm or less.

The charge-transporting layer may be formed by: preparing a coating liquid for a charge-transporting layer containing the above-mentioned respective materials and a solvent; forming a coat of the liquid; and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred, and methyl benzoate or ethyl benzoate is more preferably used.

The solvents may be used alone or as a mixture thereof

<Protective Layer>

The protective layer according to the present disclosure contains the following components (α), (β), and (γ): (α) the polymer of the hole-transportable compound represented by the formula (A); (β) the polycarbonate resin having a structural unit represented by the formula (B); and (γ) the hole-transportable compound represented by the formula (C).

The protective layer may contain electroconductive particles and any other charge-transporting substance, and any other resin.

Examples of the electroconductive particles include metal oxide particles, such as titanium oxide, zinc oxide, tin oxide, and indium oxide.

Examples of the other charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the other resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

The protective layer may contain an additive, such as an antioxidant, a UV absorber, a plasticizer, a levelling agent, a sliding property-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the protective layer is preferably 0.5 μm or more and 10 μm or less, more preferably 1 μm or more and 7 μm or less.

The protective layer may be formed by: preparing a coating liquid for a protective layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

[Process Cartridge and Electrophotographic Apparatus]

A process cartridge of the present disclosure has a feature of integrally supporting the electrophotographic photosensitive member that has been described above, and at least one unit selected from the group consisting of a charging unit, a developing unit, and a cleaning unit, and being removably mounted onto the main body of an electrophotographic apparatus.

In addition, an electrophotographic apparatus of the present disclosure has a feature of including the electrophotographic photosensitive member that has been described above, and at least one unit selected from the group consisting of a charging unit, an exposing unit, a developing unit, and a transferring unit.

An example of the schematic construction of an electrophotographic apparatus including a process cartridge 11 including an electrophotographic photosensitive member 1 is illustrated in FIGURE.

The electrophotographic photosensitive member 1 having a cylindrical shape is rotationally driven at a predetermined peripheral speed in a direction indicated by the arrow about an axis 2 as a center. The surface of the electrophotographic photosensitive member 1 is charged to a predetermined positive or negative potential by a charging unit 3. In FIGURE, a roller charging system based on a roller-type charging member is illustrated, but a charging system, such as a corona charging system, a proximity charging system, or an injection charging system, may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with toner stored in a developing unit 5, and hence a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to a treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. The electrophotographic apparatus may include an electricity-removing mechanism configured to subject the surface of the electrophotographic photosensitive member 1 to an electricity-removing treatment with pre-exposure light 10 from a pre-exposing unit (not shown). In addition, a guiding unit 12, such as a rail, may be arranged for removably mounting the process cartridge 11 of the present disclosure onto the main body of the electrophotographic apparatus.

The electrophotographic photosensitive member of the present disclosure can be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description of the following Examples, "part(s)" is by mass unless otherwise specified.

Production Example of Coating Liquid for Charge-Transporting Layer (Production Example of Coating Liquid 1 for Charge-Transporting Layer)

100 Parts of the hole-transportable compound represented by the formula (C-1), 100 parts of the resin B1, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 1 for a charge-transporting layer."

(Production Example of Coating Liquid 2 for Charge-Transporting Layer)

70 Parts of the hole-transportable compound represented by the formula (C-1), 100 parts of the resin B1, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 2 for a charge-transporting layer."

(Production Example of Coating Liquid 3 for Charge-Transporting Layer)

70 Parts of the hole-transportable compound represented by the formula (C-3), 100 parts of the resin B1, 550 parts of tetrahydrofuran, and 250 parts of toluene were mixed and filtered to provide a coating liquid for a charge-transporting layer.

The resultant coating liquid for a charge-transporting layer is defined as "a coating liquid 3 for a charge-transporting layer."

(Production Example of Coating Liquid 4 for Charge-Transporting Layer)

60 Parts of the hole-transportable compound represented by the formula (C-1), 10 parts of the hole-transportable compound represented by the formula (C-2), 30 parts of the hole-transportable compound represented by the formula (C-3), 100 parts of the resin B1, 0.2 part of a polycarbonate having a structural unit represented by the following structure (D) (weight-average molecular weight Mw: 55,000), 271 parts of o-xylene, 256 parts of methyl benzoate, and 272 parts of dimethoxymethane (methylal) were mixed and filtered to provide a coating liquid for a charge-transporting layer.

(D)

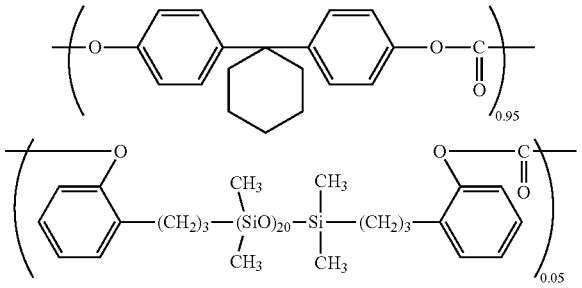

The resultant coating liquid for a charge-transporting layer is defined as "a coating liquid 4 for a charge-transporting layer."

(Production Example of Coating Liquid 5 for Charge-Transporting Layer)

50 Parts of the hole-transportable compound represented by the formula (C-1), 50 parts of the hole-transportable compound represented by the formula (C-3), 100 parts of the resin B1, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 5 for a charge-transporting layer."

(Production Example of Coating Liquid 6 for Charge-Transporting Layer)

100 Parts of the hole-transportable compound represented by the formula (C-1), 100 parts of the resin B4, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 6 for a charge-transporting layer."

(Production Example of Coating Liquid 7 for Charge-Transporting Layer)

100 Parts of the hole-transportable compound represented by the formula (C-1), 100 parts of the resin B5, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 7 for a charge-transporting layer."

(Production Example of Coating Liquid 8 for Charge-Transporting Layer)

100 Parts of the hole-transportable compound represented by the formula (C-1), 100 parts of the resin B3, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 8 for a charge-transporting layer."

(Production Example of Coating Liquid 9 for Charge-Transporting Layer)

100 Parts of the hole-transportable compound represented by the formula (C-1), 100 parts of the resin B2, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 9 for a charge-transporting layer."

(Production Example of Coating Liquid 10 for Charge-Transporting Layer)

100 Parts of the hole-transportable compound represented by the formula (C-1), 100 parts of the resin B6, 271 parts of o-xylene, 256 parts of methyl benzoate, and 272 parts of dimethoxymethane (methylal) were mixed and filtered to provide a coating liquid for a charge-transporting layer.

The resultant coating liquid for a charge-transporting layer is defined as "a coating liquid 10 for a charge-transporting layer."

Production Example of Coating Liquid for Protective Layer (Production Example of Coating Liquid 1 for Protective Layer)

70 Parts of the hole-transportable compound represented by the formula (A-5), 30 parts of 1,1,2,2,3,3,4-heptafluorocyclopentane, and 30 parts of 1-propanol were mixed to provide a coating liquid for a protective layer. The resultant coating liquid for a protective layer is defined as "a coating liquid 1 for a protective layer."

(Production Example of Coating Liquid 2 for Protective Layer)

70 Parts of the hole-transportable compound represented by the formula (A-5), 30 parts of 1,1,2,2,3,3,4-heptafluorocyclopentane, 30 parts of 1-propanol, and 0.5 part of the hole-transportable compound represented by the formula (C-3) were loaded, mixed, and filtered to provide a coating liquid for a protective layer. The resultant coating liquid for a protective layer is defined as "a coating liquid 2 for a protective layer."

(Production Example of Coating Liquid 3 for Protective Layer)

70 Parts of the hole-transportable compound represented by the formula (A-5), 30 parts of 1,1,2,2,3,3,4-heptafluorocyclopentane, 30 parts of 1-propanol, and 0.5 part of the resin B1 were loaded, mixed, and filtered to provide a coating liquid for a protective layer. The resultant coating liquid for a protective layer is defined as "a coating liquid 3 for a protective layer."

(Production Example of Coating Liquid 4 for Protective Layer)

7 Parts of trimethylolpropane triacrylate (product name: KAYARAD TMPTA, manufactured by Nippon Kayaku Co., Ltd.), 7 parts of the hole-transportable compound represented by the formula (A-8), 1 part of 1-hydroxy-cyclohexyl-phenyl-ketone (product name: IRGACURE 184, manufactured by BASF), 5 parts of cyclopentanone, and 50 parts of 1-propanol were mixed and filtered to provide a coating liquid for a protective layer. The resultant coating liquid for a protective layer is defined as "a coating liquid 4 for a protective layer."

(Production Example of Coating Liquid 5 for Protective Layer)

40 Parts of the hole-transportable compound represented by the formula (A-14), 30 parts of cyclopentanone, and 50 parts of 1-propanol were mixed and filtered to provide a coating liquid for a protective layer. The resultant coating liquid for a protective layer is defined as "a coating liquid 5 for a protective layer."

(Production Example of Coating Liquid 6 for Protective Layer)

70 Parts of the hole-transportable compound represented by the formula (A-5), 30 parts of 1,1,2,2,3,3,4-heptafluorocyclopentane, 30 parts of 1-propanol, 0.5 part of the resin B1, and 0.5 part of the hole-transportable compound represented by the formula (C-3) were loaded, mixed, and filtered to provide a coating liquid for a protective layer. The resultant coating liquid for a protective layer is defined as "a coating liquid 6 for a protective layer."

(Production Example of Coating Liquid 7 for Protective Layer)

60 Parts of the hole-transportable compound represented by the formula (A-5), 10 parts of the hole-transportable compound represented by the formula (A-8), 30 parts of 1,1,2,2,3,3,4-heptafluorocyclopentane, 30 parts of 1-propanol, and 0.5 part of resin B1 were loaded, mixed, and filtered to provide a coating liquid for a protective layer. The resultant coating liquid for a protective layer is defined as "a coating liquid 7 for a protective layer."

(Production Example of Coating Liquid 8 for Protective Layer)

7 Parts of the hole-transportable compound represented by the formula (A-14), 0.2 part of a benzoguanamine compound (product name: NIKALAC BL-60, manufactured by Sanwa Chemical Co., Ltd.), 0.1 part of 3,5-di-t-butyl-4-hydroxytoluene, 0.02 part of dodecylbenzenesulfonic acid, 30 parts of cyclopentanone, and 50 parts of cyclopentanol were mixed and filtered to provide a coating liquid for a protective layer. The resultant coating liquid for a protective layer is defined as "a coating liquid 8 for a protective layer."

(Production Example of Coating Liquid 101 for Protective Layer)

70 Parts of the hole-transportable compound represented by the formula (A-14), 2 parts of a benzoguanamine compound (product name: NIKALAC BL-60, manufactured by Sanwa Chemical Co., Ltd.), 1 part of 3,5-di-t-butyl-4-hydroxytoluene, 0.15 part of dodecylbenzenesulfonic acid, 70 parts of cyclopentanone, and 50 parts of cyclopentanol were mixed and filtered to provide a coating liquid for a protective layer. The resultant coating liquid for a protective layer is defined as "a coating liquid 101 for a protective layer."

(Production Example of Coating Liquid 102 for Protective Layer)

10 Parts of a tetrafunctional radical-polymerizable compound (product name: SR355, manufactured by Sartomer), 5 parts of the hole-transportable compound represented by the formula (A-8), 5 parts of the hole-transportable compound represented by the formula (C-7), 1 part of 1-hydroxy-cyclohexyl-phenyl-ketone (product name: IRGACURE 184, manufactured by BASF), and 100 parts of tetrahydrofuran were mixed and filtered to provide a coating liquid for a protective layer. The resultant coating liquid for a protective layer is defined as "a coating liquid 102 for a protective layer."

(Production Example of Coating Liquid 103 for Protective Layer)

100 Parts of a compound represented by the following structural formula (I), 2 parts of a polymerization initiator (product name: VE-73, manufactured by Wako Pure Chemical Industries, Ltd.), and 300 parts of isobutyl acetate were mixed and filtered to provide a coating liquid for a protective layer. The resultant coating liquid for a protective layer is defined as "a coating liquid 103 for a protective layer."

(I)

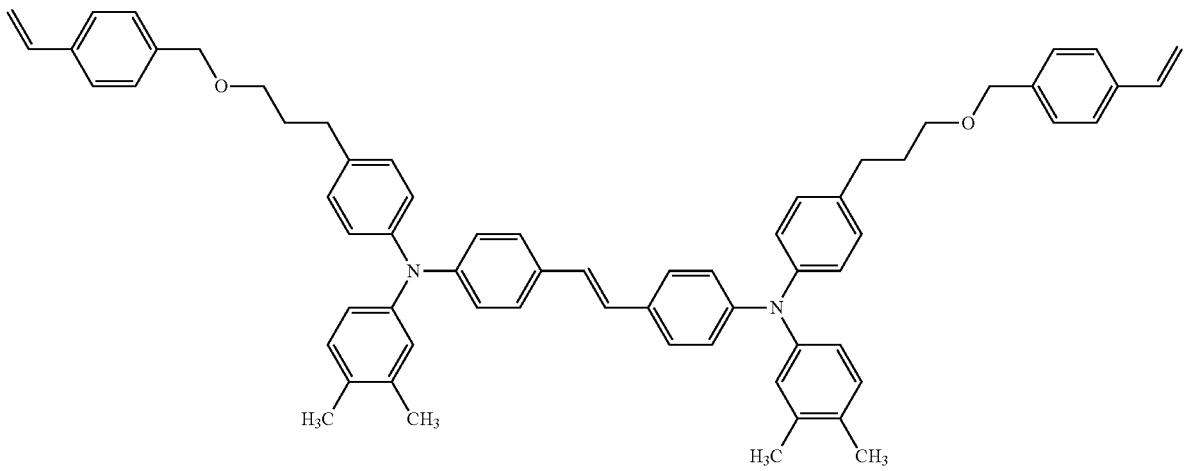

(Production Example of Coating Liquid 104 for Protective Layer)

70 Parts of the hole-transportable compound represented by the formula (A-5), 2.5 parts of the hole-transportable compound represented by the formula (C-1), 30 parts of 1,1,2,2,3,3,4-heptafluorocyclopentane, and 30 parts of 1-propanol were mixed to provide a coating liquid for a protective layer. The resultant coating liquid for a protective layer is defined as "a coating liquid 104 for a protective layer."

<Production of Electrophotographic Photosensitive Member>

Production Example of Electrophotographic Photosensitive Member (Production Example of Photosensitive Member 1)

An aluminum cylinder having a diameter of 30 mm and a length of 357.5 mm was used as a support (cylindrical support).

Next, 60 parts of barium sulfate particles coated with tin oxide (product name: PAS STRAN PC1, manufactured by Mitsui Mining & Smelting Co., Ltd.), 15 parts of titanium oxide particles (product name: TITANIX JR, manufactured by Tayca Corporation), 43 parts of a resol-type phenol resin (product name: PHENOLITE J-325, manufactured by Dainippon Ink & Chemicals, Inc., solid content: 70 mass %), 0.015 part of a silicone oil (product name: SH28PA, manufactured by Toray Silicone Co., Ltd.), 3.6 parts of silicone resin particles (product name: TOSPEARL 120, manufactured by Toshiba Silicone Co., Ltd.), 50 parts of 2-methoxy-1-propanol, and 50 parts of methanol were loaded into a ball mill, and were subjected to a dispersion treatment for 20 hours to prepare a coating liquid for an electroconductive layer. The coating liquid for an electroconductive layer was applied onto the support by dip coating, and the resultant coat was heated for 1 hour at 140° C. to be cured. Thus, an electroconductive layer having a thickness of 15 μm was formed.

Next, a coating liquid for an undercoat layer was prepared by dissolving 10 parts of a copolymerized nylon (product name: AMILAN CM8000, manufactured by Toray Industries, Inc.) and 30 parts of a methoxymethylated nylon 6 resin (product name: TORESIN EF-30T, manufactured by Teikoku Kagaku Sangyo K. K.) in a mixed solvent of 400 parts of methanol and 200 parts of n-butanol. The coating liquid for an undercoat layer was applied onto the electroconductive layer by dip coating, and the resultant coat was dried for 30 minutes at 100° C. to form an undercoat layer having a thickness of 0.45 μm.

Next, 20 parts of a hydroxygallium phthalocyanine crystal (charge-generating substance) of a crystal form having strong peaks at Bragg angles 2θ±0.2° in CuKα characteristic X-ray diffraction of 7.4° and 28.2°, 0.2 part of a calixarene compound represented by the following structural formula (1), 10 parts of a polyvinyl butyral (product name: S-LEC BX-1, manufactured by Sekisui Chemical Co., Ltd.), and 600 parts of cyclohexanone were loaded into a sand mill using glass beads each having a diameter of 1 mm. Then, the mixture was subjected to a dispersion treatment for 4 hours, followed by the addition of 700 parts of ethyl acetate. Thus, a coating liquid for a charge-generating layer was prepared. The coating liquid for a charge-generating layer was applied onto the undercoat layer by dip coating, and the resultant coat was dried for 15 minutes at 80° C. to form a charge-generating layer having a thickness of 0.17 μm.

(1)

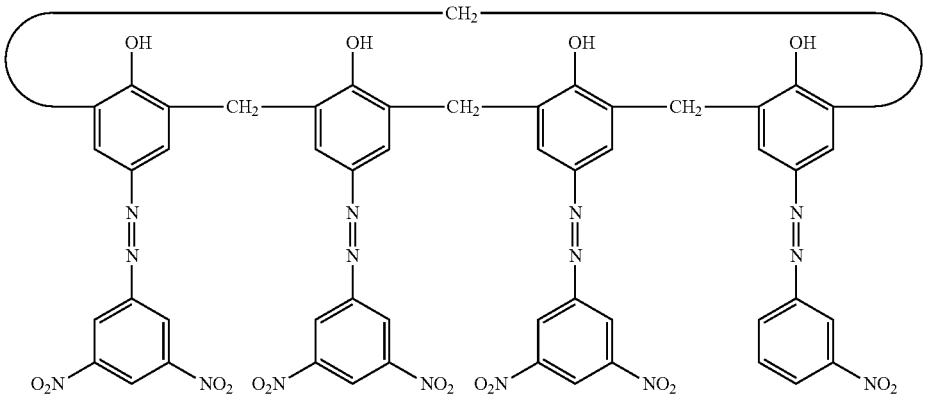

Next, the coating liquid 1 for a charge-transporting layer was applied onto the charge-generating layer by dip coating, and the temperature of the resultant coat was caused to reach 120° C. in a temperature increase time of 10 minutes, and was maintained at 120° C. for 40 minutes to dry the coat. Thus, a charge-transporting layer having a thickness of 18 μm was formed. Drying conditions for the charge-transporting layer are shown in Table 2.

Next, the coating liquid 1 for a protective layer was applied onto the charge-transporting layer by dip coating, and the resultant coat was dried for 5 minutes at 50° C. After the drying, under a nitrogen atmosphere, the coat was irradiated with electron beams under the conditions of an acceleration voltage of 60 kV and an absorbed dose of 8,000 Gy for 1.6 seconds. An oxygen concentration from the irradiation with the electron beams to a heating treatment for 1 minute was 20 μm. After that, under a nitrogen atmosphere, the temperature of the coat was increased from 25° C. to 110° C. over 10 seconds. Next, in the atmosphere, the coat was subjected to a heating treatment in a drying furnace at 100° C. for 10 minutes to form a protective layer having a thickness of 5 μm. The resultant photosensitive member is defined as "a photosensitive member 1." The content of the component (β) in the protective layer measured by an infrared spectroscopic reflection spectrum peak as described in the foregoing was 0.74 mass % with respect to the content of the component (α) in the protective layer, and the content of the component (γ) in the protective layer measured by the chromatogram of pyrolysis GC-MS as described in the foregoing was 0.82 mass % with respect to the content of the component (α) in the protective layer. Details about the resultant photosensitive member are shown in Table 2.

(Production Examples of Photosensitive Member 2 to Photosensitive Member 10)

The process up to the formation of a charge-generating layer was performed in the same manner as in the photosensitive member 1. After that, charge-transporting layers having thicknesses shown in Table 2 were each formed by using a coating liquid for a charge-transporting layer and drying conditions shown in Table 2. After that, protective layers having thicknesses shown in Table 2 were each formed in the same manner as in the photosensitive member 1 except that a coating liquid for a protective layer shown in Table 2 was used. The resultant photosensitive members are defined as "a photosensitive member 2 to a photosensitive member 10." Details about the photosensitive members are shown in Table 2.

(Production Example of Photosensitive Member 11)

The process up to the formation of a charge-generating layer was performed in the same manner as in the photosensitive member 1. After that, a charge-transporting layer having a thickness shown in Table 2 was formed by using a coating liquid for a charge-transporting layer and drying conditions shown in Table 2. Next, the coating liquid 4 for a protective layer was applied onto the formed charge-transporting layer with a spray, and was left to stand in a stream of nitrogen for 10 minutes, followed by drying to touch. Further, in a booth replaced with oxygen at a concentration of 2%, the dried product was irradiated with light by using a metal halide lamp having an irradiation intensity of 160 W/cm$^2$ at an irradiation distance of 120 mm and an irradiation intensity of 700 mW/cm$^2$ for 60 seconds. After that, the resultant was dried at 130° C. for 20 minutes to form a protective layer having a thickness of 5 μm. Thus, a photosensitive member was obtained. The resultant photosensitive member is defined as "a photosensitive member 11." Details about the photosensitive member are shown in Table 2.

(Production Example of Photosensitive Member 12)

The process up to the formation of a charge-generating layer was performed in the same manner as in the photosensitive member 1. After that, a charge-transporting layer having a thickness shown in Table 2 was formed by using a coating liquid for a charge-transporting layer and drying conditions shown in Table 2. Next, the coating liquid 5 for a protective layer was applied onto the charge-transporting layer by dip coating, and the resultant coat was dried for 5 minutes at 50° C. After the drying, under a nitrogen atmosphere, the coat was irradiated with electron beams under the conditions of an acceleration voltage of 60 kV and an absorbed dose of 8,000 Gy for 1.6 seconds. An oxygen concentration from the irradiation with the electron beams to a heating treatment for 1 minute was 20 μm. After that, under a nitrogen atmosphere, the temperature of the coat was increased from 25° C. to 110° C. over 10 seconds. Next, in the atmosphere, the coat was subjected to a heating treatment in a drying furnace at 100° C. for 10 minutes to form a protective layer having a thickness of 5 μm. The resultant photosensitive member is defined as "a photosensitive member 12." Details about the photosensitive member are shown in Table 2.

(Production Examples of Photosensitive Member 13 to Photosensitive Member 23)

The process up to the formation of a charge-generating layer was performed in the same manner as in the photosensitive member 1. After that, charge-transporting layers having thicknesses shown in Table 2 were each formed by using a coating liquid for a charge-transporting layer and drying conditions shown in Table 2. After that, protective layers were each formed in the same manner as in the photosensitive member 1 except that a coating liquid for a protective layer shown in Table 2 was used. The resultant photosensitive members are defined as "a photosensitive member 13 to a photosensitive member 23." Details about the photosensitive members are shown in Table 2.

(Production Examples of Photosensitive Member 24)

The process up to the formation of a charge-generating layer was performed in the same manner as in the photosensitive member 1. After that, a charge-transporting layer having a thickness shown in Table 2 was formed by using a coating liquid for a charge-transporting layer and drying conditions shown in Table 2. After that, the coating liquid 8 for a protective layer was applied onto the charge-transporting layer with a spray, and was then subjected to a curing reaction at a temperature of 150° C. for a time period of 30 minutes to form a protective layer having a thickness of 4 μm. The resultant photosensitive member is defined as "a photosensitive member 24." Details about the photosensitive member are shown in Table 2.

(Production Example of Photosensitive Member 25)

An aluminum cylinder having a diameter of 30 mm and a length of 357.5 mm was used as a support (cylindrical support).

Next, 100 parts of zinc oxide particles (specific surface area: 19 m2/g, powder resistance: 4.7×106 Ω·cm) serving as a metal oxide and 500 parts of toluene were stirred and mixed, and 0.8 part of a silane coupling agent was added to the mixture, followed by stirring for 6 hours. After that, toluene was evaporated under reduced pressure, and the residue was heated and dried at 130° C. for 6 hours to provide surface-treated zinc oxide particles. N-2-(Aminoethyl)-3-aminopropylmethyldimethoxysilane (product name: KBM-602, manufactured by Shin-Etsu Chemical Co., Ltd.) was used as the silane coupling agent.

Next, 15 parts of a butyral resin (product name: BM-1, manufactured by Sekisui Chemical Co., Ltd.) serving as a polyol and 15 parts of a blocked isocyanate (product name: SUMIDUR 3175, manufactured by Sumitomo Bayer Urethane Co., Ltd.) were dissolved in a mixed solvent of 73.5 parts of methyl ethyl ketone and 73.5 parts of 1-butanol. 80.8 Parts of the surface-treated zinc oxide particles and 0.8 part of 2,3,4-trihydroxybenzophenone (manufactured by Tokyo Chemical Industry Co., Ltd.) were added to the resultant solution. The mixture was subjected to a dispersion treatment with a sand mill apparatus using glass beads each having a diameter of 0.8 mm under an atmosphere at 23±3° C. for 3 hours. After the dispersion treatment, 0.01 part of a silicone oil (product name: SH28PA, manufactured by Dow Corning Toray Co., Ltd.) and 5.6 parts of crosslinked polymethyl methacrylate (PMMA) particles (product name: TECHPOLYMER SSX-102, manufactured by Sekisui Plastics Co., Ltd., average primary particle diameter: 2.5 μm) were added to the resultant, and the mixture was stirred to prepare a coating liquid for an undercoat layer.

The coating liquid for an undercoat layer was applied onto the support by dip coating to form a coat, and the coat was dried for 40 minutes at 160° C. to form an undercoat layer having a thickness of 18 μm.

Next, a charge-generating layer, a charge-transporting layer, and a protective layer were each formed in the same manner as in the production example of the photosensitive member 1. Details about the layers are shown in Table 2. The resultant photosensitive member is defined as "a photosensitive member 25."

(Production Example of Photosensitive Member 26)

The process up to the formation of a charge-generating layer was performed in the same manner as in the photosensitive member 1. After that, a charge-transporting layer having a thickness shown in Table 2 was formed by using a coating liquid for a charge-transporting layer and drying conditions shown in Table 2. After that, a protective layer was formed in the same manner as in the photosensitive member 1 except that a coating liquid for a protective layer shown in Table 2 was used. The resultant photosensitive member is defined as "a photosensitive member 26."

(Production Example of Photosensitive Member 101)

The process up to the formation of a charge-generating layer was performed in the same manner as in the photosensitive member 1. After that, a charge-transporting layer having a thickness shown in Table 2 was formed by using a coating liquid for a charge-transporting layer and drying conditions shown in Table 2. After that, a protective layer was formed in the same manner as in the photosensitive member 1 except that a coating liquid for a protective layer shown in Table 2 was used. The resultant photosensitive member is defined as "a photosensitive member 101." Details about the photosensitive member are shown in Table 2.

(Production Example of Photosensitive Member 102)

The process up to the formation of a charge-transporting layer was performed in the same manner as in the production example of the photosensitive member 1. After that, the coating liquid 1 for a protective layer was applied onto the charge-transporting layer by dip coating, and was air-dried at room temperature for 30 minutes, followed by drying at 160° C. for 1 hour. Thus, a protective layer having a thickness of 7 μm was formed. The resultant photosensitive member is defined as "a photosensitive member 102." Details about the photosensitive member are shown in Table 2.

(Production Example of Photosensitive Member 103)

The process up to the formation of a charge-transporting layer was performed in the same manner as in the production example of the photosensitive member 1. After that, the coating liquid 102 for a protective layer was applied onto the formed charge-transporting layer with a spray, and was left to stand in a stream of nitrogen for 10 minutes, followed by drying to touch. Further, in a booth replaced with oxygen at a concentration of 2%, the dried product was irradiated with light by using a metal halide lamp having a maximum irradiation intensity of 160 W/cm$^2$ at an irradiation distance of 120 mm and an irradiation intensity of 700 mW/cm$^2$ for 60 seconds. After that, the resultant was dried at 130° C. for 20 minutes to form a protective layer having a thickness of 5 μm. The resultant photosensitive member is defined as "a photosensitive member 103." Details about the photosensitive member are shown in Table 2.

(Production Example of Photosensitive Member 104)

First, the process up to the formation of a charge-generating layer was performed in the same manner as in the production example of the photosensitive member 1. After that, 55 parts of a copolymerized polycarbonate represented by the following formula (II) (viscosity-average molecular weight: 50,000), which had been synthesized by a method described in Japanese Patent Application Laid-Open No.

2014-191118, 40 parts of N,N'-diphenyl-N,N'-bis(3-methylphenyl)-[1,1']biphenyl-4,4'-diamine (TPD), and 10 parts by mass of N,N-bis(3,4-dimethylphenyl)biphenyl-4-amine were added to and dissolved in 560 parts of tetrahydrofuran and 240 parts of toluene. Thus, a coating liquid for a charge-transporting layer was obtained.

(II)

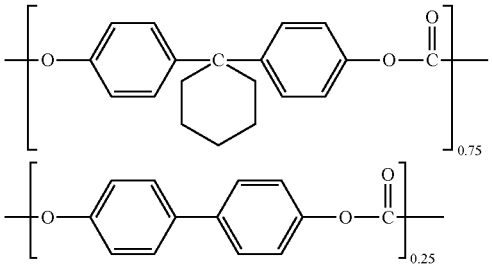

The coating liquid was applied onto the charge-generating layer, and was dried at 135° C. for 45 minutes to form a charge-transporting layer having a thickness of 25 μm. After that, the coating liquid 103 for a protective layer was applied onto the formed charge-transporting layer with a ring. After that, under a state in which an oxygen concentration was 200 μm or less, the liquid was subjected to a curing reaction at a temperature of 160° C. for a time period of 60 minutes to form a protective layer having a thickness of 7 μm. The resultant photosensitive member is defined as "a photosensitive member 104." Details about the photosensitive member are shown in Table 2.

(Production Examples of Photosensitive Member 105 and Photosensitive Member 106)

The process up to the formation of a charge-generating layer was performed in the same manner as in the photosensitive member 1. After that, charge-transporting layers having thicknesses shown in Table 2 were each formed by using a coating liquid for a charge-transporting layer and drying conditions shown in Table 2. After that, protective layers were each formed in the same manner as in the photosensitive member 1 except that a coating liquid for a protective layer shown in Table 2 was used. The resultant photosensitive members are defined as "a photosensitive member 105 and a photosensitive member 106." Details about the photosensitive members are shown in Table 2.

TABLE 2

| | Coating liquid for protective layer | Coating liquid for charge-transporting layer | Content of component (β) with respect to component (α) | Content of component (γ) with respect to component (α) | $M_\beta/M_\gamma$ | Protective layer thickness [μm] |
|---|---|---|---|---|---|---|
| Photosensitive member 1 | 1 | 1 | 0.74 | 0.82 | 0.9 | 5 |
| Photosensitive member 2 | 1 | 1 | 0.76 | 0.92 | 0.8 | 5 |
| Photosensitive member 3 | 1 | 1 | 0.013 | 0.015 | 0.9 | 5 |
| Photosensitive member 4 | 2 | 1 | 0.013 | 0.79 | 0.0 | 5 |
| Photosensitive member 5 | 1 | 2 | 1.8 | 0.7 | 2.6 | 5 |
| Photosensitive member 6 | 1 | 2 | 0.013 | 0.0015 | 8.7 | 5 |
| Photosensitive member 7 | 1 | 2 | 3.9 | 2.8 | 1.4 | 5 |
| Photosensitive member 8 | 1 | 1 | 2.8 | 2.8 | 1.0 | 5 |
| Photosensitive member 9 | 3 | 1 | 3.7 | 0.008 | 462.5 | 5 |
| Photosensitive member 10 | 3 | 1 | 3.5 | 0.002 | 1,750.0 | 5 |
| Photosensitive member 11 | 4 | 3 | 2.3 | 1.9 | 1.2 | 5 |
| Photosensitive member 12 | 5 | 3 | 3.2 | 2.1 | 1.5 | 7 |
| Photosensitive member 13 | 1 | 1 | 0.74 | 0.82 | 0.9 | 5 |
| Photosensitive member 14 | 1 | 1 | 0.011 | 0.004 | 2.8 | 5 |
| Photosensitive member 15 | 1 | 4 | 0.74 | 0.82 | 0.9 | 5 |
| Photosensitive member 16 | 1 | 5 | 0.75 | 0.8 | 0.9 | 5 |
| Photosensitive member 17 | 1 | 6 | 0.74 | 0.82 | 0.9 | 5 |
| Photosensitive member 18 | 1 | 7 | 0.74 | 0.82 | 0.9 | 5 |
| Photosensitive member 19 | 6 | 1 | 0.72 | 0.83 | 0.9 | 4 |
| Photosensitive member 20 | 1 | 8 | 0.45 | 0.55 | 0.8 | 5 |
| Photosensitive member 21 | 1 | 9 | 1.12 | 0.96 | 1.2 | 5 |
| Photosensitive member 22 | 1 | 3 | 0.78 | 0.68 | 1.1 | 5 |
| Photosensitive member 23 | 7 | 1 | 0.77 | 0.8 | 1.0 | 5 |
| Photosensitive member 24 | 8 | 8 | 3.9 | 2.9 | 1.3 | 5 |
| Photosensitive member 25 | 1 | 1 | 0.74 | 0.81 | 0.9 | 5 |
| Photosensitive member 26 | 1 | 10 | 0.75 | 0.86 | 0.9 | 5 |
| Photosensitive member 101 | 1 | 1 | 0.005 | 0 | — | 5 |
| Photosensitive member 102 | 101 | 1 | 8 | 7.8 | 1.0 | 7 |
| Photosensitive member 103 | 102 | 1 | 5.9 | 39.4 | 0.1 | 5 |
| Photosensitive member 104 | 103 | — | 6.2 | 5.2 | 1.2 | 7 |
| Photosensitive member 105 | 104 | 1 | 0.005 | 3.4 | — | 5 |
| Photosensitive member 106 | 3 | 1 | 6.7 | 2.8 | 2.4 | 5 |

| | Amount of methyl benzoate in charge-transporting layer [%] | Drying conditions for charge-transporting layer: Temperature [° C.] | Temperature increase time [min] | Maintenance time [min] | Charge-transporting layer thickness [μm] |
|---|---|---|---|---|---|
| Photosensitive member 1 | 0.8 | 120 | 10 | 40 | 18 |
| Photosensitive member 2 | 0.8 | 120 | 8 | 42 | 18 |
| Photosensitive member 3 | 0.9 | 120 | 18 | 32 | 18 |
| Photosensitive member 4 | 0.9 | 120 | 18 | 32 | 18 |
| Photosensitive member 5 | 0.8 | 120 | 6 | 44 | 18 |

TABLE 2-continued

| | | | | | |
|---|---|---|---|---|---|
| Photosensitive member 6 | 0.9 | 120 | 22 | 28 | 18 |
| Photosensitive member 7 | 0.8 | 120 | 4 | 46 | 18 |
| Photosensitive member 8 | 0.8 | 120 | 4 | 46 | 18 |
| Photosensitive member 9 | 2.4 | 90 | 20 | 30 | 18 |
| Photosensitive member 10 | 2.5 | 90 | 22 | 28 | 18 |
| Photosensitive member 11 | 0 | 120 | 10 | 40 | 18 |
| Photosensitive member 12 | 0 | 120 | 20 | 30 | 18 |
| Photosensitive member 13 | 0.8 | 120 | 10 | 40 | 18 |
| Photosensitive member 14 | 3.8 | 80 | 6 | 44 | 18 |
| Photosensitive member 15 | 0.8 | 120 | 10 | 40 | 18 |
| Photosensitive member 16 | 0.8 | 120 | 10 | 40 | 18 |
| Photosensitive member 17 | 0.8 | 120 | 10 | 40 | 18 |
| Photosensitive member 18 | 0.8 | 120 | 10 | 40 | 18 |
| Photosensitive member 19 | 0.8 | 120 | 18 | 32 | 18 |
| Photosensitive member 20 | 0.8 | 120 | 10 | 40 | 18 |
| Photosensitive member 21 | 0.8 | 120 | 10 | 40 | 18 |
| Photosensitive member 22 | 0 | 120 | 10 | 40 | 18 |
| Photosensitive member 23 | 0.8 | 120 | 10 | 40 | 18 |
| Photosensitive member 24 | 0 | 120 | 20 | 30 | 18 |
| Photosensitive member 25 | 0.8 | 120 | 10 | 40 | 18 |
| Photosensitive member 26 | 0.8 | 120 | 10 | 40 | 18 |
| Photosensitive member 101 | 0.9 | 120 | 22 | 28 | 18 |
| Photosensitive member 102 | — | 135 | 10 | 40 | 18 |
| Photosensitive member 103 | — | 120 | 10 | 40 | 18 |
| Photosensitive member 104 | — | 135 | 10 | 40 | 25 |
| Photosensitive member 105 | 0.9 | 120 | 22 | 28 | 18 |
| Photosensitive member 106 | 0.8 | 120 | 4 | 46 | 18 |

Evaluation

<Photomemory>

(Evaluation of Photosensitive Member 1)

The two photosensitive members 1 were prepared, and one of the photosensitive members was mounted on the cyan station of a reconstructed machine of an electrophotographic apparatus (copying machine) (product name: imageRUNNER (trademark) ADVANCE C5255, manufactured by Canon Inc.) serving as an evaluation apparatus. Under an environment at 23° C. and 50% RH, the initial potential of the electrophotographic photosensitive member arranged on the cyan station of the evaluation apparatus was adjusted in advance by setting conditions for a charging apparatus and an image-exposing apparatus so that the dark potential (Vd) and light potential (Vl) of the electrophotographic photosensitive member became −700 V and −200 V, respectively.

Next, the surface of the other photosensitive member 1 was wrapped with a light-shielding sheet having opened therein a rectangular hole measuring 15 mm in the rotation direction of the photosensitive member by 100 mm in the longitudinal direction of the photosensitive member, and the resultant was exposed to white daylight having an illuminance of 1,500 lx for 5 minutes. After that, the resultant was arranged on the cyan station of the evaluation apparatus, and the surface potential of the photosensitive member was measured 5 minutes after the completion of the light exposure under the preset conditions.

The absolute value of a difference in light potential between the portion exposed to the white daylight through the hole opened in the light-shielding sheet and the light-shielded portion was defined as a photomemory. Ranks were set as described below.

A: 0 V to 5 V
B: 6 V to 10 V
C: 11 V to 15 V
D: 16 V to 25 V
E: 26 V or more

The result of the evaluation is shown in Table 3.

(Evaluations of Photosensitive Member 2 to Photosensitive Member 106)

Evaluations were each performed by the same approach as that of the photosensitive member 1. The results are shown in Table 3.

<Increase in Residual Potential>

(Evaluation of Photosensitive Member 1)

The photosensitive member 1 was mounted on the cyan station of a reconstructed machine of an electrophotographic apparatus (copying machine) (product name: imageRUNNER (trademark) ADVANCE C5255, manufactured by Canon Inc.) serving as an evaluation apparatus. Under an environment at 23° C. and 50% RH, conditions for a charging apparatus and an image-exposing apparatus were set so that the dark potential (Vd) and light potential (Vl) of the electrophotographic photosensitive member arranged on the cyan station of the evaluation apparatus became −700 V and −200 V, respectively. The surface potential (residual potential) of the photosensitive member after the removal of its electricity was measured under the conditions. A difference in residual potential between the initial photosensitive member and the photosensitive member after the output of 100 images was confirmed.

A: 20 V or less

B: 21 V or more

The result of the evaluation is shown in Table 3.

(Evaluations of Photosensitive Member 2 to Photosensitive Member 106)

Evaluations were each performed by the same approach as that of the photosensitive member 1. The results are shown in Table 3.

TABLE 3

| | Photosensitive member | Photomemory [V] | Photomemory evaluation rank | Residual potential |
|---|---|---|---|---|
| Example 1 | Photosensitive member 1 | 4 | A | A |
| Example 2 | Photosensitive member 2 | 5 | A | A |
| Example 3 | Photosensitive member 3 | 4 | A | A |
| Example 4 | Photosensitive member 4 | 7 | B | A |
| Example 5 | Photosensitive member 5 | 8 | B | A |
| Example 6 | Photosensitive member 6 | 9 | B | A |
| Example 7 | Photosensitive member 7 | 13 | C | A |
| Example 8 | Photosensitive member 8 | 12 | C | A |
| Example 9 | Photosensitive member 9 | 13 | C | A |
| Example 10 | Photosensitive member 10 | 17 | D | A |
| Example 11 | Photosensitive member 11 | 25 | D | A |
| Example 12 | Photosensitive member 12 | 20 | D | A |
| Example 13 | Photosensitive member 13 | 4 | A | A |
| Example 14 | Photosensitive member 14 | 8 | A | A |
| Example 15 | Photosensitive member 15 | 3 | A | A |
| Example 16 | Photosensitive member 16 | 4 | A | A |
| Example 17 | Photosensitive member 17 | 4 | A | A |
| Example 18 | Photosensitive member 18 | 4 | A | A |
| Example 19 | Photosensitive member 19 | 4 | A | A |
| Example 20 | Photosensitive member 20 | 3 | A | A |
| Example 21 | Photosensitive member 21 | 4 | A | A |
| Example 22 | Photosensitive member 22 | 7 | B | A |
| Example 23 | Photosensitive member 23 | 4 | A | A |
| Example 24 | Photosensitive member 24 | 22 | D | A |
| Example 25 | Photosensitive member 25 | 4 | A | A |
| Example 26 | Photosensitive member 26 | 3 | A | A |
| Comparative Example 1 | Photosensitive member 101 | 26 | E | A |
| Comparative Example 2 | Photosensitive member 102 | 35 | E | B |
| Comparative Example 3 | Photosensitive member 103 | 28 | E | A |
| Comparative Example 4 | Photosensitive member 104 | 35 | E | B |
| Comparative Example 5 | Photosensitive member 105 | 28 | E | A |
| Comparative Example 6 | Photosensitive member 106 | 15 | C | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-114505, filed on Jun. 9, 2017, which is hereby incorporated by reference herein in its entirety.

What is claimed is:

1. An electrophotographic photosensitive member, comprising:

a support;

a charge-generating layer on the support;

a charge-transporting layer on the charge-generating layer; and a protective layer on the charge-transporting layer, the protective layer comprising components (α), (β), and (γ):

(α) a polymer of a hole-transportable compound represented by formula (A)

(A)

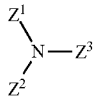

where $Z^1$ to $Z^3$ independently represent an optionally substituted aryl group, and a substituent of the aryl group comprises a linear or branched alkyl group having 1 to 6 carbon atoms, a halogen atom or a polymerizable functional group, provided that the hole-transportable compound represented by the formula (A) has one or more polymerizable functional groups each serving as the substituent;

(β) a polycarbonate resin having a structural unit represented by formula (B)

(B)

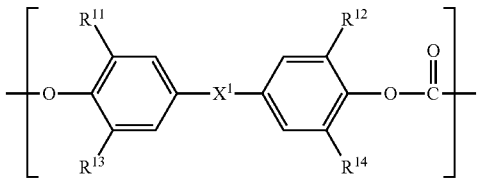

where $R^{11}$ to $R^{14}$ independently represent a hydrogen atom, a methyl group or an ethyl group, and $X^1$ represents a single bond, an oxygen atom or a divalent hydrocarbon group; and (γ) a hole-transportable compound represented by formula (C)

(C)

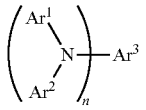

where $Ar^1$ and $Ar^2$ independently represent a substituted or unsubstituted phenyl group, $Ar^3$ represents an n-valent aromatic group and n represents an integer of 1 to 3, provided that component (γ) is free from any polymerizable functional group, wherein a content of component ((3) in the protective layer is 0.01 to 4.0 mass % with respect to a content of component (a) in the protective layer, a content of component (γ) in the protective layer is 0.001 to 3.0 mass % with respect to the content of component (a) in the protective layer, and the charge-transporting layer contains component (γ).

2. An electrophotographic photosensitive member according to claim 1, wherein the polymerizable functional group comprises an acryloyloxy group or a methacryloyloxy group.

3. An electrophotographic photosensitive member according to claim 1, wherein the polymerizable functional group comprises a hydroxy group or a hydroxymethyl group.

4. An electrophotographic photosensitive member according to claim 1, wherein the content of component (β) in the protective layer is 0.01 to 2.0 mass % with respect to the content of component (α) in the protective layer, and the content of component (γ) in the protective layer is 0.001 to 1.0 mass % with respect to the content of component (α) in the protective layer.

5. An electrophotographic photosensitive member according to claim 1, wherein the content of component (β) in the protective layer is 0.01 to 0.8 mass % with respect to the content of component (α) in the protective layer, and the content of component (γ) in the protective layer is 0.01 to 1.0 mass % with respect to the content of component (α) in the protective layer.

6. An electrophotographic photosensitive member according to claim 1, wherein a mass ratio content $M_\beta$ of component (β) in the protective layer and a content $M_\gamma$ of component (γ) in the protective layer satisfy $0.8 \leq M_\beta/M_\gamma \leq 500$.

7. An electrophotographic photosensitive member according to claim 1, wherein the charge-transporting layer contains component (δ) which is at least one member selected from the group consisting of methyl benzoate and ethyl benzoate, and a content of component (δ) in the charge-transporting layer is 0.8 to 5.0 mass % with respect to a total mass of the charge-transporting layer.

8. An electrophotographic photosensitive member according to claim 1, wherein $Ar^1$ and $Ar^2$ independently represent a phenyl group which may be substituted with at least one group selected from the group consisting of an alkyl group having 1 to 4 carbon atoms, an alkoxy group having 1 to 4 carbon atoms and an unsaturated hydrocarbon group having 2 to 4 carbon atoms.

9. An electrophotographic photosensitive member according to claim 1, wherein the polymerizable functional group of formula (A) is selected from the group consisting of an acryloyloxy group, a methacryloyloxy group, a hydroxy group and a hydroxymethyl group.

10. An electrophotographic photosensitive member according to claim 1, wherein formula (A) has two or more polymerizable functional group independently selected from the group consisting of an acryloyloxy group and a methacryloyloxy group.

11. A process cartridge, comprising:

an electrophotographic photosensitive member and at least one unit selected from the group consisting of a charging unit, a developing unit and a cleaning unit;

the process cartridge integrally supporting the electrophotographic photosensitive member and the at least one unit, and being removably mounted onto a main body of an electrophotographic apparatus;

the electrophotographic photosensitive member comprising a support, a charge-generating layer on the support, a charge-transporting layer on the charge-generating layer, and a protective layer on the charge-transporting layer; and the protective layer comprising components (α), (β), and (γ):

(α) a polymer of a hole-transportable compound represented by formula (A)

(A)

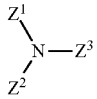

where $Z^1$ to $Z^3$ independently represent an optionally substituted aryl group, and a substituent of the aryl group comprises a linear or branched alkyl group having 1 to 6 carbon atoms, a halogen atom or a polymerizable functional group, provided that the hole-transportable compound represented by the formula (A) has one or more polymerizable functional groups each serving as the substituent;

(β) a polycarbonate resin having a structural unit represented by formula (B)

(B)

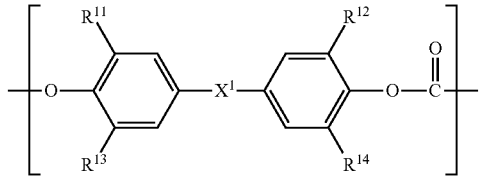

where $R^{11}$ to $R^{14}$ independently represent a hydrogen atom, a methyl group or an ethyl group, and $X^1$ represents a single bond, an oxygen atom or a divalent hydrocarbon group; and (γ) a hole-transportable compound represented by formula (C)

(C)

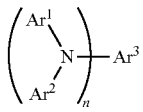

where $Ar^1$ and $Ar^2$ independently represent a substituted or unsubstituted phenyl group, $Ar^3$ represents an n-valent aromatic group and n represents an integer of 1 to 3, provided that component (γ) is free from any polymerizable functional group, wherein a content of component (β) in the protective layer is 0.01 to 4.0 mass % with respect to a content of component (α) in the protective layer, a content of component (γ) in the protective layer is 0.001 to 3.0 mass % with respect to the content of component (α) in the protective layer, and the charge-transporting layer contains component (γ).

12. An electrophotographic apparatus, comprising:

an electrophotographic photosensitive member and at least one unit selected from the group consisting of a charging unit, an exposing unit, a developing unit and a transferring unit;

the electrophotographic photosensitive member comprising a support, a charge-generating layer on the support, a charge-transporting layer on the charge-generating layer, and a protective layer on the charge-transporting layer; and the protective layer comprising components (α), (β), and (γ):

(α) a polymer of a hole-transportable compound represented by formula (A)

(A)

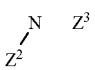

where $Z^1$ to $Z^3$ independently represent an optionally substituted aryl group, and a substituent of the aryl group comprises a linear or branched alkyl group having 1 to 6 carbon atoms, a halogen atom or a polymerizable functional group, provided that the hole-transportable compound represented by the formula (A) has one or more polymerizable functional groups each serving as the substituent;

(β) a polycarbonate resin having a structural unit represented by formula (B)

(B)

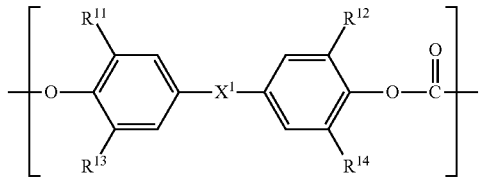

where $R^{11}$ to $R^{14}$ independently represent a hydrogen atom, a methyl group or an ethyl group, and $X^1$ represents a single bond, an oxygen atom or a divalent hydrocarbon group; and (γ) a hole-transportable compound represented by formula (C)

(C)

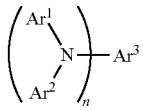

where $Ar^1$ and $Ar^2$ independently represent a substituted or unsubstituted phenyl group, $Ar^3$ represents an n-valent aromatic group and n represents an integer of 1 to 3, provided that component (γ) is free from any polymerizable functional group, wherein a content of component (β) in the protective layer is 0.01 to 4.0 mass % with respect to a content of component (α) in the protective layer, a content of component (γ) in the protective layer is 0.001 to 3.0 mass % with respect to the content of component (α) in the protective layer, and the charge-transporting layer contains component (γ).

* * * * *